United States Patent [19]

Busch et al.

[11] Patent Number: 4,922,826

[45] Date of Patent: May 8, 1990

[54] ACTIVE COMPONENT OF SUBMUNITION, AS WELL AS FLECHETTE WARHEAD AND FLECHETTES THEREFOR

[75] Inventors: Jurgen-Michael Busch, Wendelstein; Georg Stammel, Lauf/Peg.; Siegfried Rhau, Neunkirchen; Bernd Gundel, Neuhaus; Karl Rudolf, Schrobenhausen, all of Fed. Rep. of Germany

[73] Assignee: Diehl GmbH & Co., Nuremberg, Fed. Rep. of Germany

[21] Appl. No.: 242,736

[22] Filed: Sep. 9, 1988

[30] Foreign Application Priority Data

Mar. 2, 1988 [DE] Fed. Rep. of Germany ..... 3806731

[51] Int. Cl.[5] ..... F42B 13/50

[52] U.S. Cl. ..... 102/489; 102/357; 102/703

[58] Field of Search ..... 102/380, 393, 340, 342, 102/351, 357, 489, 505, 703

[56] References Cited

U.S. PATENT DOCUMENTS

| | | | |
|---|---|---|---|
| 3,318,241 | 5/1967 | Gould | 102/489 |
| 3,673,047 | 6/1972 | Buth et al. | 102/703 |
| 3,727,861 | 4/1973 | Swann | 102/351 |
| 3,771,455 | 11/1973 | Haas | 102/380 |
| 4,714,020 | 12/1987 | Hertsgaard et al. | 102/351 |
| 4,770,101 | 9/1988 | Robertson et al. | 102/489 |

FOREIGN PATENT DOCUMENTS

| | | | |
|---|---|---|---|
| 2091855 | 8/1982 | United Kingdom | 102/505 |

*Primary Examiner*—Harold J. Tudor

*Attorney, Agent, or Firm*—Scully, Scott, Murphy & Presser

[57] ABSTRACT

An active component of submunition for utilization from a carrier against different target objects, especially against semi-hard and hard or heavily armored target objects; as well as warheads for this purpose and flechettes which are preferably deployed over the targets through the intermediary of such warheads. The active component incorporates at least one warhead having flechettes, which is equipped with a propellant or propulsion mechanism for the acceleration of the warhead in the direction of effect for the flechettes, and with an ejector piston for additional acceleration of the flechettes through the ejection from the precedingly accelerated warhead.

8 Claims, 3 Drawing Sheets

ARRESTING DEVICE
EXPLOSIVE FRAGMEN-TATION CHARGE
GAS GENERATOR
EXPANSION CHARGE
TIME-DELAY FUSE
96
98
99
100
59
67
104
68
105
111
60
101
103
102
66
97
63

SENSOR
TRIGGERING APPARATUS
96
68
99
107
59
99
111
119
110
60
108
106
109
66
97
63

ACTIVE COMPONENT OF SUBMUNITION, AS WELL AS FLECHETTE WARHEAD AND FLECHETTES THEREFOR

BACKGROUND OF THE INVENTION

1. Field of the Invention

The present invention relates to an active component of submunition for utilization from a carrier against different target objects, especially against semi-hard and hard or heavily armored target objects; as well as warheads for this purpose and flechettes which are preferably deployed over the targets through the intermediary of such warheads.

2. Discussion of the Prior Art

Modern artillery rocket systems, such as the MLRS family of weapons, are provided with an active component for utilization against semi-hard to heavily or hard-armored target object over a greater deployment distance for an attack against the target from above, and wherein the active component is equipped with so-called bomblets possessing mechanical impact-proximity fuzes. The jet effect or action of the insert of each individual hollow charge-bomblet is essentially quite low in the target area; however, for a dense bomblet dispersion over the target object, there is expected a multiple-impact action with a correspondingly enhanced effect in the target object.

However, that kind of concept with regard to the active component is subject to the disadvantage in that the underlying multiple-action of inherently small active charges necessitates an extremely dense strewing of the submunition bomblets over the target area. This can already result in launching or starting errors during the descent into the target area due to mutual collisions of the densely strewed out bomblets; and in particular, by means of a predetermined volume of active components there can only be covered a limited target area; in essence, the probability of multiple strikes or hits in dispersed target object is thereby relatively low. However, above all, the effect of such types of ordinary active component-bomblets reduces itself quite drastically when they are utilized against target objects in a protected condition; in effect, for example, such as against armored vehicles or against highways and concrete aircraft taxiways under natural leafy screening, under light protective roofs, or under artificial camouflage installations. In this instance, the branches of trees, the lattice work of protective roofs, or the retaining framework of camouflage netting leads to the triggering of the bomblets striking thereagainst, already before the actual target objects (vehicles or roadways) which are located therebeneath are actually struck, and thereby leads to the destruction of the bomblets at an uncritical distance from the actual target objects.

SUMMARY OF THE INVENTION

In recognition of these conditions it is, accordingly, an object of the present invention to equip an active component of this type, which is deployable over a target object, in such a manner that it allows itself to be utilized more effectively against a broadest possible pallete or spectrum of target objects and, in particular, also against targets which are in a protected condition.

The foregoing object is inventively attained in that the active component, as set forth hereinabove, incorporates at least one warhead having flechettes, which is equipped with a propellant or propulsion mechanism for the acceleration of the warhead in the direction of effect for the flechettes, and with an ejector piston for additional acceleration of the flechettes through the ejection from the precedingly accelerated warhead.

Basically, a flechette warhead per se is known from the disclosure of U.S. Pat. No. 4,211,169. However, in that instance, fin-stabilized flechettes are arranged radially spaced about a central ejector charge, in front of individual, small plate-shaped ejector pistons. Because of the horizontally oriented jet-like discharge, the warhead housing remains essentially intact during the acceleration of the flechettes. Hereby, the velocity which is attainable at a representative dimensioning of the housing and of the ejector charge; in effect the achievable effectiveness of the flechettes in especially semi-hard to hard armored target objects, is relatively limited. This previously known flechette warhead is consequently utilizable only as a wide-surfaced blocking weapon against soft or unarmored targets. When, in the interest of obtaining a not to widely spread out region of effect; in essence, over relatively short distances to the target, and in order to attain a higher kinetic energy, the firing velocity can be significantly increased notwithstanding the given limitations on apparatus, on the other hand, the high starting speed over a short accelerating distance will leads to aerodynamic instabilities; in effect, will not result in the required axial penetration into heavily or hard-armored target objects.

Contrastingly, an inventive flechette warhead with its double follow-up acceleration of the flechettes, at first due to the acceleration of its housing in the direction of effectiveness of the flechettes, and then additionally due to acceleration during the ejection of the flechette from the housing, thereby facilitating that, without any problems as to aerodynamic stability, to attain within a relatively short distance the high starting velocity for the highly-energetic penetration of the flechettes into the target object, even from a relatively short distance to the target, whereby without practically any loss in energy and without any influence over the direction of flight, the flechettes will penetrate through natural coverings and artificial protective measures above the target objects; referring to German Laid-Open Patent Appln. No. 33 37 115.

Thereby, in view of the foregoing, it is possible to realize an extremely effective, and thereby lightly-constructed; in essence, expediently deployable active component against a broad target spectrum, in particular also those in a covered condition, through means which pose provide no problems with regard to apparatus.

BRIEF DESCRIPTION OF THE DRAWINGS

Reference may now be had to the following detailed description of exemplary embodiments of the invention, illustrative of further features and advantages thereof, taken in conjunction with the accompanying drawings; in which.

DETAILED DESCRIPTION

Figure 1:
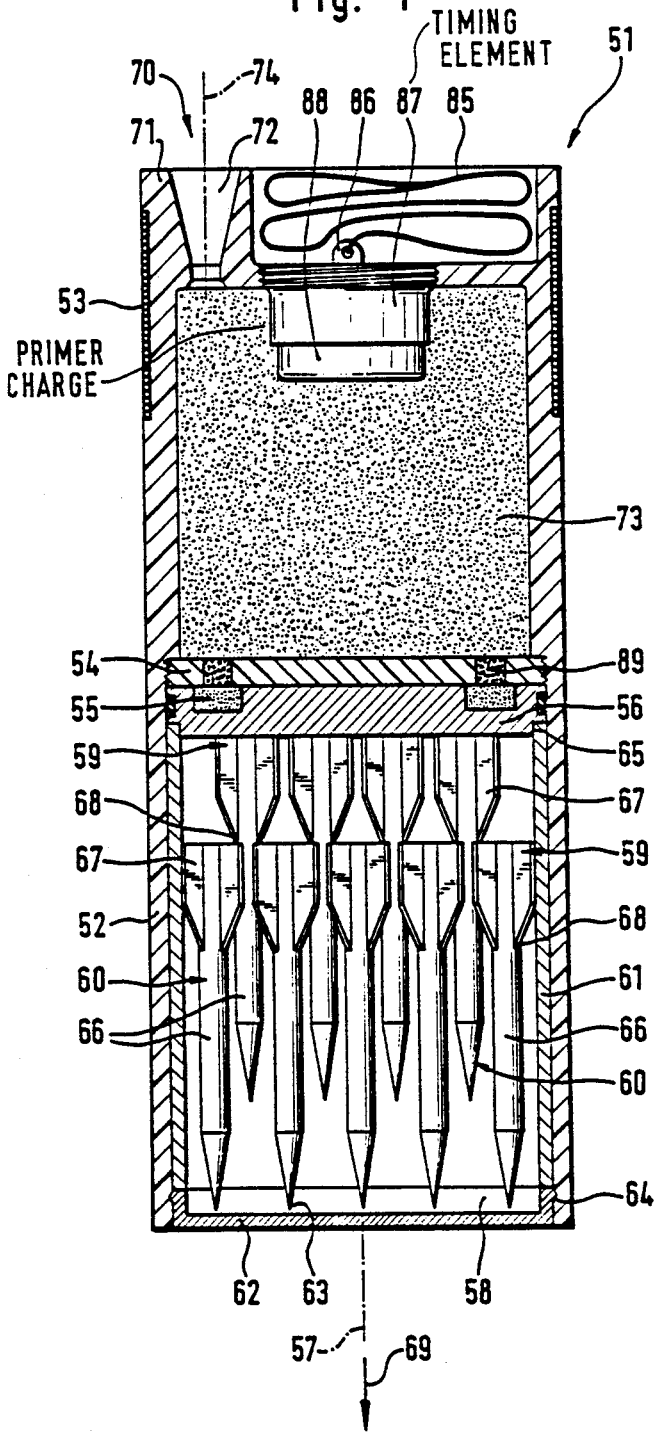
FIG. 1 illustrates a longitudinal sectional view through a flechette warhead with an integrated acceleration system and an ejector arrangement for the flechettes thereof.

The flechette warhead 51 which is represented in FIG. 1 of the drawings essentially consists of a hollow-cylindrical housing 52. In the interest of obtaining a lower mass which is to be additionally accelerated, the housing is constructed of preferably a material such as fiberglass-reinforced plastic material, with an additional fiber-wound reinforcement 53 for the strengthening of the in particular intensely radially stressed wall regions. In front of a damming or barrier plate 54 which is axially and radially fixed in generally the transverse-mid plane of the housing 52, which in this instance is dimensioned as a flat-cylindrical ring, there is arranged an ejecting charge 55 for the acceleration of a plate-shaped ejecting piston 56 in the direction along the axis 57 of the housing towards the opening 58 at the end of the housing. Supported directly and/or indirectly in this direction of movement or action 69 in front of the ejecting piston 56 are the tail ends 59 of fin-stabilized projectiles; in this case, so-called flechettes 60. They are radially supported in a dense or close axially-parallel packing by collar-like molds or shells 61, which are axially conducted along the inner casing surface of the wall structure of the housing 52 which leads towards the opening 58, and supported at the rear against the ejecting piston 56, whereby they are guided in a radially stiffened manner through engagement into an annular groove 65 formed in the front side of the piston. The opening 58 is closed off by a thin cover 62 immediately in front of the tips 63 of the flechettes 60 which are packed so as to project axially most forwardly. The cover is fixed in position by an easily detachable form-fitted connection 64 on the inner casing surface of the housing 52.

The flechettes are accelerated to such a velocity through the intermediary of the ejecting piston 56, that their arrow-like tips 63 will penetrate with a high kinetic energy into semi-hard as well as heavily or hard-armored target objects; for instance, into the subterrain, even into concrete-covered subterrain. Inasmuch as camouflages and similar coverings (such as the leaves or branches of trees or thin roofs of parking sheds) can be penetrated without any substantial energy loss, a flechette warhead 51 of this type can be effectively utilized, in particular against targets in a protective position. The flechette shanks 66, which are either round or polygonal in cross-section, are weight-stabilized (through the displacement of the center of gravity from the geometric middle point in a direction towards the tip 63) or, as illustrated, are stabilized pursuant to the preferred constructional embodiment, by means of tail end fins 67. The shank 56 (for weight-stabilized flechettes 60 in every instance the heavier forward portion of the shank 66) is preferably constituted of a penetrating material of high density, such as tungsten or other heavy metal. The large elongation of the shank 66 in comparison with its diameter provides for a high piercing power upon striking against a target.

In the equipping of the flechettes 60 with stabilizing fins 67, as illustrated in the drawings, expedient provisions can be made such that the flechettes 60 are alternatingly axially offset for the achieving of dense axially-parallel packing in the housing 52. Thereby, the rearwardly positioned flechettes 60 can be supported at their tail ends with their fins 67 being directly supported against the front surface of the ejecting piston 56, whereas the fins 67 of the further forwardly positioned flechettes 60 which are arranged therebetween, will partly encompass the neighboring shanks 66, and are supported at their tail ends against the front connections 68 of the fins 67 located behind thereof; in effect, are first supported through these indirectly against the ejecting piston 56.

In the interest of obtaining a shorter constructional length for the warhead in the practical implementation thereof, the distance of acceleration for the ejecting piston 56 is relatively short. When flechettes 60 are imparted a high degree of acceleration over a relatively short distance, in order to be able to be brought to the necessary launching or starting velocity which must be obtained for the required kinetic energy which is to be converted upon striking against a target, the foregoing can result in generating conditions of aerodynamic instability. As a consequence thereof, the flechettes 60 are not launched from a quasi-stationary warhead housing 52, but from a warhead 51 which is accelerated prior thereto in the direction of effectiveness 69 of the flechettes. Hereby, in order not to have to be dependent upon the motion which is encountered during ejection from a carrier system, the warhead 51 is equipped behind the ejecting piston 56 with a recoil or reaction propulsion mechanism 70 for effecting the acceleration of the entire warhead 51 in the direction of action 69.

This propulsion mechanism possesses at least one nozzle 72, but preferably a plurality of nozzles 72 which are arranged symmetrical to the longitudinal axis 57 of the warhead 51 in the base 71 of the housing. The rearward portion of the warhead housing 52, which receiving the propellent composition 73 for this acceleration system; in effect, acts also as the combustion chamber thereof. When the axes 74 of eccentrically arranged nozzle 72 possess only also a slight offset (in the magnitude of about one degree) relative to the longitudinal axis 57 of the system, this will thereby impart a spinning moment to the warhead 51 about its longitudinal axis 57; for example, to somewhat intensify a spin which is already somewhat present during the dispensing from the carrier 75. Resulting therefrom, in an advantageous manner, is a constructively predeterminable optimum dispersing spread (and thereby a greater region of effectiveness in the target area) upon the ejection of the flechettes 60, without the need that these must be supported deviatingly behind the ejecting opening 58 by the optimally axially-parallel packing; for example, would have to be guided during launching with attendant losses.

Figure 2:
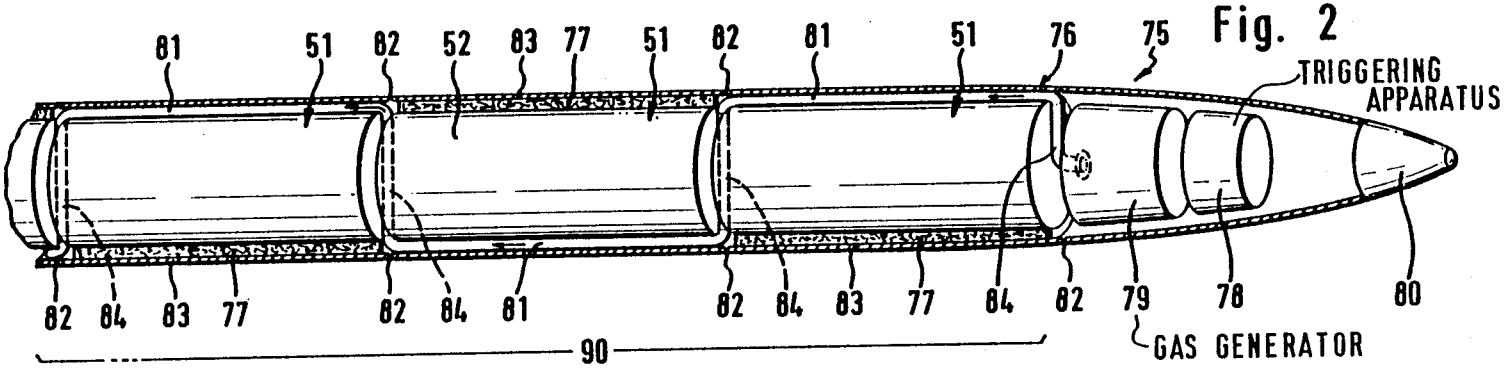
FIG. 2 illustrates, generally diagrammatically, an airborne body forming a deployment system for an active component with a plurality of approximately caliber-filling warheads pursuant to FIG. 1, with consideration given to an ejection system for expedient dispersion statistics.

FIG. 2 illustrates, in a generally schematic manner, a carrier 75 in a kind of an artillery rocket, such as is generally known as an MLRS rocket of the MARS weapon system. Coaxially arranged within the casing 76 are a plurality of almost full-caliber sized submunition warheads 51 which constitute active component containers, with the enclosure thereof in profiled plastic shells or cups 77 in order to compensate for radial play. By means of either a time-controlled or remote-controlled triggering apparatus 78, there is activated a gas generator 79 behind the nose cone 80 of the projectile, which pushes the stack of warheads 51; for example, axially outwardly from the tail end of the casing 76.

However, in order to increase the surface effect of the active component 90, in effect, to increase the surface spread in the distribution of the flechettes 60 over the target area, for the discharge of the warheads 51 from the carrier 75 there is preferably provided a radial ejection towards different sides. For this purpose, a hose 81 which is inflatable by the gas generator 79, extends along the inner wall surface of the casing 76 in a meanderingly alternating made at different sides of the tandemly located warheads 51. In view of the foregoing, there is covered a radius of action which, in generally, could not be serviced by an active component 90 in the shape of a single warhead 51; at least not with a comparable degree of effectiveness.

The casing 76 of the carrier is provided with breaking locations 82 diametrically opposite the run of the hose 81, which lead to the lateral or sideways blowing off of casing fragments 83 by means of pyrotechnic charges which activated from the triggering apparatus 78 (or through the radial pressure loading or stressing of the inflated hose 81), in order to open the carrier casing 76 at these locations for the lateral expulsion of the warheads 51 in different directions. Serving as diametrical connections between the hoses 81 which are inflatable and which are arranged on different sides, and also as a blow-up or inflating tube for connection to the gas generator 79, are suitably rigid feeder tubes 84, so as not to obstruct the radial expulsion sequence through axial expansion loads among the warheads 51.

Each warhead 51, as illustrated in FIG. 1, is expediently equipped with an aerodynamic braking device 85 in the region of its base 71, such as in the nature of a small braking parachute or balloon. This is released when the warhead 51 has been released from the carrier 75. The braking action leads to that the longitudinal axis 57 of the warhead, and thereby its direction of action 69, is oriented more rapidly into the direction of descent; in effect, towards the target area; especially for the case in which the warheads 51 are ejected during a flat trajectory for the carrier 75 (not from a steep path of descent). The tensile load which is exerted on the restrain 86 by the braking action, starts a timing element 87 for the delayed triggering of a primer charge 88, and to thereby ignite the propellent charge 73; in essence, to start the propulsion mechanism 70.

Predicated upon the thus commencing acceleration, or initiated from the timing element 87, the braking device 85 is released from its restraint 86, and the warhead 51 is accelerated in the direction of effect or action 69 of the flechettes. When the propellent charge 73 has burnt down to the barrier or damming plate 54, then by means of a passageway 89 extending through the plate it ignites the ejecting charge 55; for example, through a propagation or primer charge. As a result thereof, the ejecting piston 56 is accelerated in the direction of action 69. The impulse leads to that the cover 62 is slid forwardly out of its connections 64 with the housing, and is slung away sideways because of the spin of the warhead.

Also the cuff shells 61 are slung away sideways after leaving the opening 58 of the housing, and the flechettes 60 can move towards the target area with a high axial velocity under a radial dispersion.

Figure 3:
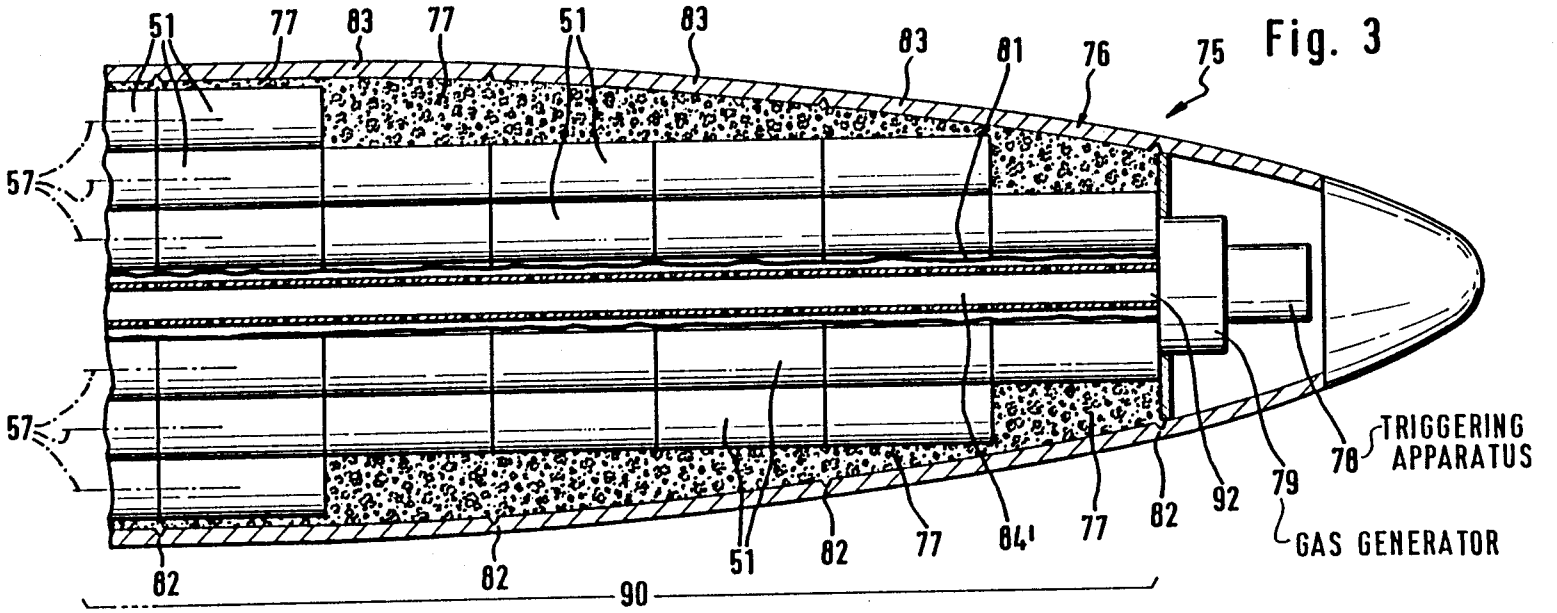
FIG. 3 illustrates the equipping of a noncylindrical region of an airborne body with an active component constituted of sub-calibered warheads pursuant to FIG. 1.

For a larger caliber-sized carrier 75, in the interest of obtaining a broad field of dispersion for the ejected warheads 51, it is expedient to arrange axially-parallel stacks of subcalibered warheads 51 eccentrically adjacent each other. When, such as in generally the tactical army rockets ATACMS, the active component 90 pursuant to the ammunition technology, realized through the warheads 51, must be stored in the region of the carrier 75 which reduced conically towards the front (as in FIG. 3), then due to reasons in the manufacturing technology and logistics, it is additionally expedient to be able to have to only prepare cylindrical warheads 51 of the same diameter for the equipping. The foamed material shells 77 are then profiled in such a manner that they can be fitted in from the rear because of the conical radial remaining distance besides the always outermost position of warheads 51 from the inner mantle surface of the casing 76 (upon occasion, under the inclusion of ignition control cables which are located therein, (not shown in the drawing). However, for the equipping, in an expedient manner, the warheads 51 are preassembled while still outside of the carrier casing 76 in receiving apertures on the inside of two or more axially parallel parts of the shells 77, which are thereafter (under the central inclusion of a perforated feed tube 84' which is encompassed by the hose 81) assembled into the frustoconical active component 90; for example, glued to each other. The active component 90 which is preequipped in this manner can be inserted from rearwardly into the conical region of the carrier casing 76, until the infeed opening 92 of the tube 84' couples to the gas generator 79. The springing away of the shell portions 83 of the carrier casing 76 at the breaking locations 82 for the lateral dispersion or scattering of the flechette warheads 51 is then again effected, as described in conjunction with FIG. 2, through the inflating of a displacement or expelling hose 81 which extends coaxially wound about the pressure gas-conducting feed tube 84', or by means of pyrotechnic charges.

Figure 4:
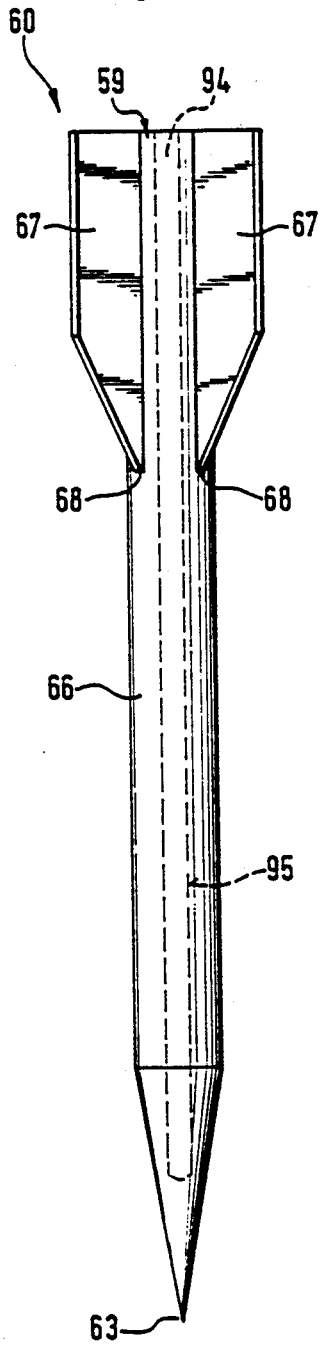
FIG. 4 illustrates a fin-stabilized flechette from a warhead pursuant to FIG. 1, with an incendiary composition application for an enhanced secondary effect in semi-hard to hard armored target objects.

The effect of the highly-energetic penetration of the target by the flechettes 60 can be further considerably enhanced by a secondary incendiary composition effect. For flechettes 60 which are stabilized through the distribution of weight along the shank 66, this is suitably constructed from a composite member constituted of materials possessing different densities, with the specifically more heavy material being located rearwardly of the tip 63 of the flechette. For fin-stabilized flechettes 60 as in the instance of FIGS. 1 and 4, at least the entire shank 66 rearwardly the ballistically optimized geometry of the tip 63 is homogeneously formed from a material of a high density. At least in a rearward portion of the shank 66 is the latter designed as a hollow body for the receipt of a highly combustible or incendiary composition 94. The hollow space 95 expediently extends even in the shape of a concentric bore through the entire length of the shank 66 into the region of the tip 61, in order to be able to introduce with assurance the greatest possible volume of incendiary composition 94 into the pierced open target object. The composition 94 ignites at the latest due to the heating upon striking the target; however, upon occasion, also due to the heat of friction during high-speed travel through the air; but an ignition does not take place because of the acceleration caused by the ejecting piston 56 relative to the housing 52 of the warhead (FIG. 1), so that during the launching there are avoided any mutually adherent incendiary effects among the not yet spread apart scattered flechettes 60.

A mixture of materials with zirconium can serve as the incendiary composition 94, or because of the higher combustion temperatures, a mixture with aluminum oxide. Preferably, the hollow space 95 which is coaxially encompassed by the shank 66 is filled with a so-called active incendiary composition 94 which is essentially constituted of only reduction media, which react with hot material particles, and thereby maintain the incendiary reaction, inasmuch as the surrounding air is adequate as an oxidizer.

Such active incendiary compositions 94 which burn down or combust under a high temperature are available inexpensively and in large quantities in the form of titanium alloys obtained from the employment of residues or remainders from welding electrodes, and can be welded without any technological problems into the hollow space 95. However, other cautonide materials; in effect, highly-combustible incendiary materials are also employable in this connection, especially as the so-called cermix metals, in essence, mixtures of rare-earth metals which readily react with oxygen, such as are marketed because of their ready ignitability and high heat of combustion as basic materials for the flintstones of pocket lighters.

In conformance with the herein above-elucidated target scenario, it can be expedient, instead of the flechettes 60 providing a secondary effect with incendiary compositions or in addition thereto; in essence, in the mix of the types of equipment, to deploy warheads 51 which hinder or considerably render even impossible the logistic or advancing movements of the enemy within the target area. Also for this purpose is it possible to employ the active components 90, whose warheads 51 will be especially effective against target objects in protective positions at locations which are covered by camouflage.

Figure 5:
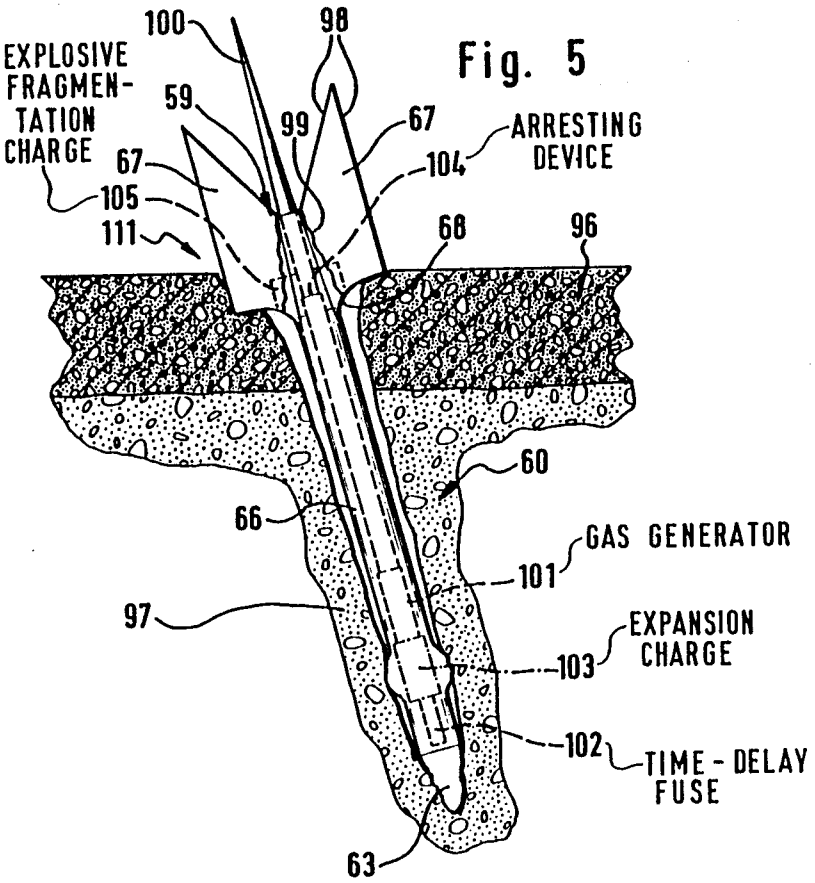
FIG. 5 illustrates a flechette configuration as an evacuation-protected roadway block subsequent to its penetration into the ground.

FIG. 5 illustrates the example of the penetration of a concrete covering or apron 96 (such as a taxiway for aircraft) with the piercing of the flechette shank 66 into the compacted earth region 97 which is therebeneath. Besides the deformation of the tip 63 of the shank, the piercing motion, in particular, is braked by the radially outwardly projecting front connection 68 for the stabilizing fins 67 in the tail end region of the shank 66. The fins 67 which thereby protrude rearwardly to some extent above the concrete covering 96 are equipped with knife or razor-sharp edges 98 and, to thereby be able to cut through vehicle tires, insofar as the vehicle itself is not caught in this protruding rearward portion of the flechettes 60. It can also be provided that the knife edged fins 67 may be permitted to shear off along breaking locations 99 during braking of the piercing motion into the earth region 97, such that they can be scattered over the neighborhood of the piercing location as cutting fragments, and thereby significantly obstructing vehicular traffic with pneumatic tires.

In order to sufficiently project above the concrete covering 96 at the penetrating location 111 so as to thereby form obstructions, in accordance with FIG. 5 provision can be made to have a sharp-pointed mandrel or tip 100 extend telescope-like from the tail end 59 of the flechette, and which also serves for the damaging of pneumatic tires or vehicle chassis during their travel over this concrete covering 96. For effecting the telescope-like displacement, there can be actuated a small gas generator 101 by a time delay fuse 102 for certain period of time after the penetration into the earth region 97. Concurrently, this can also detonate an expansion charge 103 in the forward portion of the shank 66, in order to fix the shank 66 as rigidly as possible in position through wedging into the formed penetrating passageway. This hinders any rearward pulling out of the shank 66 for the clearing of the penetrating location 111.

The rearward arresting 104 of the mandrel 100 which is extended outwardly of the tail end 59 of the shank can also be concurrently designed to be able to ignite an explosive fragmentation charge 105 when, within the scope of clearing attempts, a bending stress acts on the mandrel 100 to such an extent that this will resultingly cause the release; for example, of a prestressedly-latched trigger mechanism. This provides an effective hindrance to the clearing of any such blocked taxiways.

Figure 6:
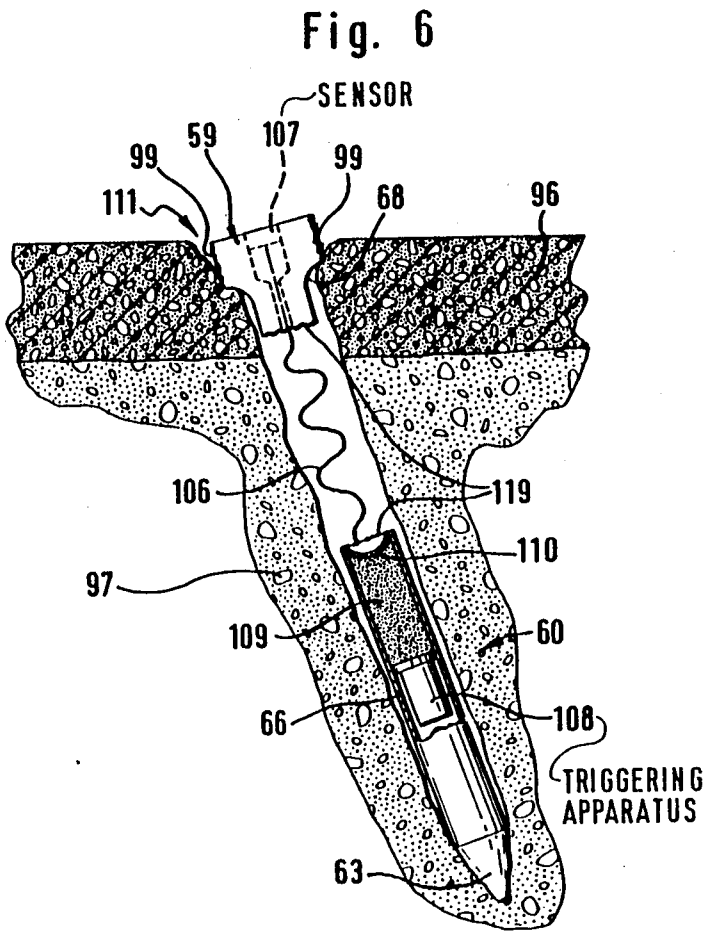
FIG. 6 illustrates, in a modification of the conditions of FIG. 5, a flechette configuration as a ground mine which has penetrated into the subterrain.

In an embodiment which is modified with respect to FIG. 5, for flechettes 60 which penetrate into the earth region 97, pursuant to FIG. 6 there is provided, in front of the radially outwardly projecting front attachments 68 at the tail end, a (further) breaking location 119 extending transversely of the longitudinal extent of the shank 66. The latter rips apart at this location due to the penetrating braking action of the tail end 59, and the forward region (with regard to direction and depth in dependance upon the extent of the deformation of the shank tip 63) penetrates further into the earth region 97.

However, a connection 106 remains between the tail end 59 and the forward shank portion 66 for the transmission of a triggering or detonating signal, when a sensor 107 arranged in the tail end 59 detects the over rolling by a heavy vehicle, especially by the track chains of an armored vehicle. Consequently, through the connection 106 there is activated a triggering apparatus 108, and thereby detonated a combat charge 109 with a projectile-forming insert 110 which is released at the shaft end rearwardly from the breaking location 119; in effect, oriented towards the tail end 59. Thus, the combat charge 109 acts directly against the driving mechanism of the vehicle to the over rolling of which there responds the sensor 107. Concurrently, at the tail end 59 or in proximity thereto (when the illustrated tail end 59 and shank 66 do not remain precisely coaxially oriented), an earth crater is torn open, as a result of which there is at least frequently hindered any travel over this route. The connection 106 (or an additional connection) can be concurrently designed as a relatively stiff tension spring, in order to prevent that the separated tail end 59 with the sensor will jump out again from the penetrating location 111 due to recoil effects.

Thus, through the intermediary of the above-described flechettes 60 there can be produced a compact warhead 51 which is employable against, and in particular against targets in a protective condition under a widespread active or effective mechanism which, in any event, is lighter than the active component 90 of a conventional bomblet with the same requirements for space in the carrier 75. Inasmuch as an ordinary active component 90, as discussed, possesses only a slight degree of effectiveness in passing through a natural or artificial camouflage, under the same deployment conditions and apparatus, by means of warheads 51 of the above-described type it is possible that over greater ranges there can be carried out a more effective attack against an enemy, and especially also against covered positions and assembling or staging areas.

What is claimed is:

1. An active component of articles of submunition which are deployable from a carrier against different types of target objects, especially such as semi-hard and heavily armored target objects, said active component comprising at least one warhead having a housing; a plurality of flechettes arranged axially-parallel within said housing; a propulsion mechanism for effectuating the acceleration of the warhead in the direction of effectiveness for said flechettes, said propulsion mechanism including means for imparting a rotational acceleration to said warhead about the longitudinal axis thereof; means for imparting an acceleration to an ejecting piston for imparting an additional acceleration to said flechettes for ejection thereof from the precedingly accelerated warhead, a coaxial stack of said warheads of substantially full-caliber size being arranged in said carrier; an inflatable ejector hose meanderingly extending within said carrier along surface portions of said warheads; and means for rupturing said carrier and facilitating said hose to radially expel said warheads in different directions from said ruptured carrier.

2. Active component as claimed in claim 1, wherein an aerodynamic braking device is activated for a short term upon release of said warhead from said carrier for implementing a spatial orientation in the direction of effectiveness of said warhead; and a timing element for initiating the delayed activation of said propulsion mechanism subsequent to release of said warhead from said carrier.

3. Active component as claimed in claim 1, wherein said means for imparting acceleration to said ejecting piston comprises an ejector charge, said ejector charge being triggered by a propellant charge of said propulsion mechanism; a damming plate axially dividing said housing intermediate said propellant charge of the propulsion mechanism and said ejector charge, said ejector charge being triggerable through at least one transmission passageway formed in said damming plate.

4. Active component as claimed in claim 1, wherein said flechettes comprise fin-stabilized flechettes, said flechettes being arranged in a dense axially parallel stacking axially offset relative to each other in front of the ejecting piston.

5. An active component of articles of submunition which are deployable from a carrier against different types of target objects, especially such as semi-hard and heavily armored target objects, said active component comprising at least one warhead having a housing; a plurality of flechettes arranged axially-parallel within said housing; a propulsion mechanism for effectuating the acceleration of the warhead in the direction of effectiveness for said flechettes, said propulsion mechanism including means for imparting a rotational acceleration to said warhead about the longitudinal axis thereof; means for imparting an acceleration to an ejecting piston for imparting an additional acceleration to said flechettes for ejection thereof from the precedingly accelerated warhead, a plurality of axially-parallel stacks of said warheads being arranged within said carrier, said warheads being preassembled in divided profiled shells extending about a central ejecting hose, and said shells being mounted as a rotationally-symmetrical unit within said carrier.

6. Active component as claimed in claim 5, wherein an aerodynamic braking device is activated for a short term upon release of said warhead from said carrier for implementing a spatial orientation in the direction of effectiveness of said warhead; and a timing element for initiating the delayed activation of said propulsion mechanism subsequent to release of said warhead from said carrier.

7. Active component as claimed in claim 5, wherein said means for imparting acceleration to said ejection piston comprises an ejector charge, said ejector charge being triggered by a propellant charge of said propulsion mechanism; a damming plate axially dividing said housing intermediate said propellant charge of the propulsion mechanism and said ejector charge, said ejector charge being triggerable through at least one transmission passageway formed in said damming plate.

8. Active component as claimed in claim 5, wherein said flechettes comprise fin-stabilized flechettes, said flechettes being arranged in a dense axially parallel stacking axially offset relative to each other in front of the ejecting piston.

* * * * *